US007354265B2

(12) United States Patent
Mashhour et al.

(10) Patent No.: US 7,354,265 B2
(45) Date of Patent: Apr. 8, 2008

(54) FLARE STACK COMBUSTION METHOD AND APPARATUS

(75) Inventors: Mazen M. Mashhour, Dhahran (SA); Rashid Khan, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 11/003,105

(22) Filed: Dec. 2, 2004

(65) Prior Publication Data

US 2006/0121399 A1 Jun. 8, 2006

(51) Int. Cl.
*F23D 14/00* (2006.01)
*F23G 7/08* (2006.01)

(52) U.S. Cl. ..... 431/202; 431/5; 431/350; 431/12; 422/168

(58) Field of Classification Search ..... 431/202, 431/5, 182, 185, 355, 350, 12; 110/344, 110/345, 346; 422/168
See application file for complete search history.

(56) References Cited

U.S. PATENT DOCUMENTS 3,554,681 A * 1/1971 Proctor ..... 431/202
4,105,394 A * 8/1978 Reed et al. ..... 431/202
4,323,343 A * 4/1982 Reed et al. ..... 431/202
4,643,669 A * 2/1987 Bozai ..... 431/202

FOREIGN PATENT DOCUMENTS

GB 2 081 872 A * 2/1982

* cited by examiner

*Primary Examiner*—Josiah C. Cocks
(74) *Attorney, Agent, or Firm*—Abelman, Frayne & Schwab

(57) ABSTRACT

High-pressure air is discharged in the form of jets moving at a high velocity from nozzles mounted on a ring around the interior of the flare stack, placed at a predetermined distance from the flare tip and the portion of the surrounding stack wall downstream of the jets is perforated with air passages to admit atmospheric air. The high-velocity air movement induces a larger volume of air from the atmosphere to enter the stack where it rises to the flame zone, thereby lifting the flame and enhancing turbulent mixing of air and gas in the flame zone. Adequate stoichiometric amounts of oxygen to assure complete combustion are determined by measuring any variations of the mass flow rate of the fuel gas and/or undesired chemical and effecting a corresponding adjustment of an air flow control valve to admit a predetermined amount of pressurized air and/or atmospheric air to the flaring tip. A Coanda-effect body is positioned proximate the open end of the flare stack to improve the mixing of the air feedstream with atmospheric air and combustible components and to elevate the heat of the flame above the metal structural elements that control air flow at the top of the flare stack.

23 Claims, 5 Drawing Sheets

110
112
122
120
P
C
124
104
106
100
70
102
132
130
134
136
138
139
34
82
50
92
80
10

FLARE STACK COMBUSTION METHOD AND APPARATUS

FIELD OF INVENTION

This invention relates to the construction and operation of flaring or flare stacks with enhanced atmospheric air flow that are utilized to burn undesired by-product streams for release into the atmosphere.

BACKGROUND OF THE INVENTION

This invention provides improvements to the apparatus and methods disclosed in PCT/US02/12443, published application WO 02/086386, the disclosure of which is hereby incorporated in its entirety by reference.

The flaring or assisted open combustion of undesired process by-product streams is commonly used to oxidize and convert toxic gases and vapors to their less harmful combustion products for release into the environment. A mixture of the undesired product and a fuel are directed to the base of the flare stack to form a feedstream that rises to the flare tip or stack outlet where the mixture is ignited in the combustion zone to form the flare or flame. The efficient and complete combustion of the mixture is not always achieved. When the process is not properly managed, smoke is also produced by this process. Smoke can be an indicator that the combustion process is incomplete, and that the toxic or otherwise undesired process materials have not been converted to less harmful forms. Smoke is also a visible constituent of air pollution, and its elimination or reduction is a consistent operational goal.

In order to reduce smoke production, the installation of auxiliary pressurized air and steam systems in conjunction with flaring stacks is well known in the prior art. The low-pressure air assist system uses forced air to provide the air and fuel mixing required for smokeless operation. A fan, commonly installed in the bottom of the flare stack, provides the combustion air required. Steam assisted flare systems use a steam ring and nozzles to inject steam into the combustion zone at the flare tip where air, steam and fuel gas are mixed together to produce a smokeless flame. In some systems of the prior art, a concentric barrier or shield surrounds the flare tip or outlet in order to channel atmospheric air into a rising mass that is drawn to the gases emitted from the flaring stack barrel.

Steam and low-pressure air assists for flaring are in common use because both systems are considered by the art to be generally effective and relatively economical as compared to alternative means for disposing of the undesired by-products.

However, both of these prior art systems have various drawbacks and deficiencies. The low-pressure air assists requires a significant capital expenditure for at least one fan that must be dedicated to the flare stack. Steam assist systems typically require sophisticated control devices, have relatively high utility requirements and maintenance/replacement schedules. Continuous operation imposes a rigorous maintenance schedule and even a back-up system in case of a breakdown or a requirement for major repairs.

An improvement to these prior art systems, as disclosed in WO 02/086386 is a plurality of high pressure air jet nozzles positioned on a manifold located between a concentric shield and the exterior of the flare stack outlet. The adjacent surface of the shield is perforated to enhance the flow of atmospheric air into the space between the shield and stack. In practice, this construction was found to be effective in eliminating or substantially reducing smoke. However, the related structure at the top of the stack was exposed to extremely high-temperature combustion gas resulting in a shortened useful life for the equipment.

Based upon operating experience with the apparatus and methods of the prior art as disclosed in WO 02/086386, it has been found that the enhanced combustion of the feedstream gas components was achieved along with the suppression of smoke. However, the increased concentration of heat in the turbulent gases was found to have shortened the life of the metal components employed to control and direct the gaseous flow of the feedstream and the induced ambient air flow, as well as the high and low pressure air jets and associated piping. Thus, the need exists to provide an apparatus and method for improved flaring that will extend the useful operating life of the fabricated metal components at the flaring tip.

It is therefore an object of this invention to provide improved apparatus and methods of operation of a stack that will avoid the concentration of high temperature turbulent gases in the proximity of the tip components.

Another object of the invention is to provide means for controlling the mass of pressurized air to assure adequate mixing with the feedstream and the complete combustion of the undesired chemical component and fuel based upon predetermined actual stoichiometric requirements.

Yet another object of the invention is to operate the flaring stack so that the combustion zone is elevated above the shield and other related tip components in order to minimize their exposure to the burning gases at their highest temperature.

It is another principal object of the present invention to provide an apparatus and method for enhancing the complete combustion of flare gases that is highly effective in promoting the efficient and complete combustion of the fuel and undesired chemicals without smoke, that requires minimal maintenance, and that is adaptable to the variation in day-to-day operating conditions that may be expected in industrial plant operations.

Another object of the invention is to provide a method and apparatus that is readily adapted for use with existing flaring stacks without significantly modifying the existing stack barrel and feedstream component delivery system.

The terms flaring stack and flare stack are used interchangeably in this description. As used herein atmospheric air means the ambient air surrounding the stack and is distinguished from air pressurized delivered via high or low pressure conduits and/or discharged from nozzles. Sources of pressurized air delivered to the nozzles should be free of deris to avoid interfering with the operation of the nozzles.

SUMMARY OF THE INVENTION

The above objects and additional advantages are provided by the apparatus and method of the present invention, which comprehends the novel elements and functions that are described below.

1. Air Mass Flow Control

In one aspect of the invention, means for controlling the fuel-to-air ratio are provided to insure the complete combustion of these components at the flaring stack tip by providing at least a stoichiometric amount of oxygen is delivered to the feedstream containing the fuel and undesired chemical. A flow meter or other measuring means is provided to confirm that the mass of the air provided to the flaring system is more than the minimum stoichiometric amount required to assure complete combustion of the feedstream components. In a preferred embodiment the flow meter generates a signal, most preferably a digital signal, that corresponds to the current air mass flow. The flow meter signal is input to a processor, which can be a programmed general purpose computer. When the processed signal indicates that a sufficient amount of oxygen is being delivered to the flaring zone, another signal is output to a flow control means.

The flow control means can include a flow control valve with an electronically directed controller that is responsive to an electrical signal, e.g., the signal from the processor. Such valve controllers and associated valves are well-known in the art.

This embodiment of the invention also preferably includes analytical means to determine the stoichiometric oxygen requirements for complete combustion of the feedstream components. In order to determine the minimum amount of air to provide sufficient oxygen to result in the complete combustion of the fuel and undesired chemical component(s) of the flare stack feedstream, automated analytical means are provided for determining the stoichiometric oxygen requirements for the complete combustion of the feedstream components that can make up the undesired materials to be burned. For any given facility, the undesired components that might be fed to the flare stack will be known and their analytical characteristics can be determined. The results of the analysis are entered into the program, which in turn provides a predetermined signal to the valve controller to provide at least the minimum mass flow of air required under the prevailing conditions.

Automated analytical means are most preferably employed in conjunction with an appropriately programmed general purpose computer to provide a corresponding signal. Suitable analytical devices are well-known and commercially available in the art.

In an especially preferred embodiment, the signal corresponding to the stoichiometric oxygen requirement for a given sample of the flaring stack feedstream is stored and also transmitted to the flow valve controller that has been calibrated to admit the required mass of pressurized air under the prevailing pressure and temperature conditions.

In a further preferred embodiment of the present invention, the apparatus includes an air flow control valve that is employed to directly control the flow of high-pressure air into the flaring stack and also to indirectly control the amount of ambient atmospheric air that is drawn into the combustion zone at the upper end of the stack. The operation of the control valve is most preferably automated to respond to digital signals received from a programmed general purpose computer.

In the event that the facility operates in a substantially steady-state condition with respect to the amount of undesired chemicals to be flared, the need for analysis of the fuel and undesired chemical components can be infrequent, e.g., monthly, and would be undertaken only to confirm the consistent operation of the analytical equipment and flow control valve operating means.

In those field operations where the composition of the stack feedstream is not subject to change and/or significant variation, sampling and calibration checks can be scheduled at greater intervals. If it is known or anticipated that the composition of the feedstream changes with some greater frequency that is dependent upon less predictable variables associated with the overall operations of the facility, automated sampling of the feedstream can be scheduled at pre-determined intervals. The results of the analysis of a sample are stored in an associated system memory device and compared with the current volume of air being supplied; any adjustments are determined and an appropriate signal is sent to the electronic controller for the air flow control valve so that the appropriate amount of oxygen is mixed with the feedstream.

Where operating conditions in the facility result in fluctuations of the mass and/or type of undesired chemical(s), then more frequent analytical testing is required to assure that the proper stoichiometric quantities of fuel and oxygen/air are being introduced into the flaring system to assure complete combustion and suppression of smoke. Under these operating conditions, signals from the analytical means will be routinely input to the programmed computer for generation of the appropriate digital signal which in turn is sent to the control means for actuating the flow control valve setting. As will be apparent to those skilled in the art of instrumentation and control, fluctuations in upstream operating conditions can be used to activate automated sampling devices to determine the composition of the components of the feedstream.

As will also be apparent to one of ordinary skill in the art, changes in the volumetric flow and/or pressure of the air admitted into the stack will also cause changes in the volume of ambient air drawn into the system, either through the stack or into the annular space between the outside of the stack and the inside of a shield mounted proximate the stack outlet. These volumetric and mass flow rates can be calculated using well established formulae and/or determined empirically in control laboratory tests or in the field. In view of the environmental factors such as ambient air temperature, humidity and wind conditions, calculations of the stoichiometric oxygen/air requirements will be used to establish a minimum value, and a design factor multiple will be applied to increase the actual high-pressure air addition to account for environmental and any other relevant external factors.

In a particularly preferred embodiment of the invention, the pressurized air directed to the flare stack is used to create regions of low pressure that draw additional atmospheric air into the mass of air and the feedstream that is moving toward the stack outlet in order to enhance combustion of the flare feedstream. The amount of atmospheric air drawn into the system is determined experimentally and/or empirically, and is also taken into account in connection with the amount of high-pressure air admitted into the system by the air flow control valve.

2. Flare Stack Air Jets

In one aspect, the method and apparatus broadly comprehend minimizing the direct contact of the flame and the radiation heat load on the metal structural elements of the flare tip. This effect is achieved by providing an increased air flow which not only supports complete combustion of the feedstream, but also serves to lift the flame and to carry away the heat from the vicinity of the tip.

In a further embodiment of the invention, high-pressure air amplifier nozzles are installed on the interior of the flaring stack in proximity to the stack outlet to direct a plurality of fast moving air jets upwardly towards the stack outlet. A portion of the flare stack above the location of the internal air amplifier nozzles is provided with a plurality of perforations which permit the influx of atmospheric air into the moving air mass in the stack as a result of the low pressure zone created by the rapidly moving air jets emitted from the amplifier nozzles.

As used herein, the terms "air flow amplifier" and "air amplifiers" refer to a nozzle that uses a venturi in combination with a source of compressed air to produce a high velocity, high volume and low-pressure airflow output. Suitable devices are described in U.S. Pat. Nos. 4,046,492 and 6,243,966, the disclosures of which are incorporated herein by reference and are made a part of this application. The compressed air is fed to an annular chamber or manifold surrounding the narrowed throat or high-velocity section of the venturi. The compressed air is then directed by an annular throttle in the manifold to flow downstream along the inner surface of the venturi, towards the outlet. The high-pressure air stream entering from the manifold generally conforms to the smooth flowing curvature of the inner walls of the center section and outlet consistent with a Coanda profile. This conforming airflow creates a low pressure region in the venturi that draws large volumes of air into the inlet and produces the desired high velocity, high volume and low-pressure air output from the amplifier device. Use of air amplifier nozzles having an amplification ratio of at least 10:1 and up to 75:1, or even 300:1 are preferred. This compares with ratio of about 3:1 for conventional nozzles.

Air amplifier nozzles suitable for use in the practice of the invention are commercially available from Exair Corp. of Cincinnati, Ohio, Nexflow Technologies of Amhearst, N.Y. and Artix Limited, each of which companies maintains a website with a corresponding address.

In one embodiment of the method and apparatus of the invention, the plurality of high-velocity jets or streams of air are positioned in the interior of the flaring stack at a location below the stack outlet. The portion of the stack immediately above the air jets is provided with perforations to admit ambient air surrounding the stack. The high-pressure air emitted from the jets moves in the direction of the flame zone to create an interior zone of rapidly moving air that is at a lower pressure than that of the surrounding atmospheric air mass. This low-pressure interior zone draws atmospheric air through the perforations in the stack and creates a larger mass of air moving in the direction of the combustion zone. This larger mass of air is directed into the combustion zone to assist in mixing and to achieve complete combustion of the feedstream during the flaring.

The nozzles are preferably mounted on a circular manifold surrounding the interior surface of the stack wall and connected to a source of high-pressure air by piping that passes through the stack wall. The high-pressure air is provided by piping that extends up the exterior of, and through the wall of the flare stack to the high-pressure air distribution ring manifold and air jets. A zone of turbulence that is needed for smokeless operation is thereby created in advance of the combustion zone.

The specific configuration of the apparatus used in the practice of the invention varies according to the flare gas rate and the geometry of the flare tip or outlet. The invention makes economical the use of high-pressure air. The volume of compressed air required is relatively small compared to the requirements for either low-pressure air or the steam used in the systems of the prior art. Moreover, the piping and nozzles are not subjected to the adverse effects of steam. As noted above, the pressurized air should be free of debris.

In a particularly preferred embodiment of the present invention, the stack outlet is surrounded by a shield as in prior art installations and the flare barrel perforations extend from the air amplifier jets vertically to a position corresponding to the lower rim of the surrounding shield.

3. Installation of Coanda-Effect Body

In yet a further preferred embodiment of the invention, a Coanda-effect body member is mounted above the stack outlet to further modify the pattern of movement of the air and the fuel and undesired chemical components in the feedstream, and to enhance mixing with air to promote complete combustion.

As used herein the term "Coanda-effect body member" means a closed surface that when having a surface contour or shape placed in a fluid stream, causes an impinging fluid to follow the surface to thereby increase the fluid flow rate while it is in contact with the surface.

The Coanda-effect body member for use in the invention is defined by the rotation of one, but preferably two intersecting arcs about a vertical axis corresponding to the axis of the flaring stack. The Coanda-effect body member is solid and its lower surface facing the stack outlet is upwardly curved. The lower arcuate surface is defined by an arc of a circle having a smaller diameter than the upper arcuate surface of the Coanda-effect body which results in a cross-sectional configuration resembling that of a pine cone. The behavior of fluids moving over a Coanda-effect body surface are well defined in the literature and the specific configuration of the exterior surface is determined based upon the actual size and operating conditions present in a particular flaring stack installation.

In accordance with the practice of the invention, the feedstack components and any auxiliary air discharged from the flaring stack outlet impinge upon the lower curved portion of the Coanda-effect body member and slip along its exterior surface at a higher velocity, thereby creating a surrounding zone of low pressure air which leads to mixing with the surrounding ambient air. The actual combustion occurs in the region of the upper portion of the Coanda body member and/or in the space above the body. This method of operation reduces the heat load on the upper portion of the flaring stack and the related components such as the concentric shield, if present, supports, manifolds and associated low pressure air jets, and the like.

It is known from the prior art to utilize the Coanda-effect in the construction and operation of flaring stacks. The devices of the prior art are known as "tulip tips". The use of such a device is disclosed in U.S. Pat. No. 4,634,372. It has been found that the tulip tips produce smokeless flames only under a limited range of operating conditions. The tulip tip is not effective when wind conditions are unstable and proper operation requires relatively high gas flow rates. Furthermore, because of the large contact area between the flames and the metal of the tip, these prior art devices have a relatively short operating life.

A Coanda-effect body member is positioned above the stack outlet where it is contacted on its underside by the feedstream and on its upper surface by the fast-moving high volume of atmospheric air and pressurized air that moves between the stack and the surrounding shield. Mixing is achieved as a result of the Coanda-effect that occurs when a stream of fluid emerging from a confining source tends to follow a curved surface that it contacts and is thereby diverted from its original direction prior to impingement. Thus, if a stream of air is flowing along a solid surface which is curved slightly away from the original direction of the air stream, the stream will tend to follow the surface in order to maximize the contact time between the fluid stream and the curved surface. Depending upon the type of fluid and the operating conditions, the radius of curvature that will maintain the maximum contact time varies. If the radius of curvature is too sharp, the fluid stream will maintain contact for a time and then break away and continue its flow. Empirical determinations can be made based upon the pressure and flow rate of the fluid stream.

The Coanda-effect body member of the present invention is preferably supported by a plurality of radially-extending support members that are secured to the surrounding shield. The configuration and materials of construction of these supports are selected to maximize their useful life, e.g., by adopting a streamline design with reference to the air flow.

A particularly preferred material of construction is a corrosion resistant alloy of nickel, iron and chromium sold by High Performance Alloys Inc. of Tipton, Ind. 46072 under the trademark INCOLOY®. A particularly preferred product is INCOLOY® 800 HT which has a high creep rupture strength. The chemical balance of the alloy should exhibit excellent resistance to carburization, oxidation and nitriding environments in order to further minimize failure and fatigue caused by exposure of metal components to the high temperatures of combustion over prolonged periods of time. The alloy selected should resist imbrittlement after long periods of usage in the 1200° to 1600° F. temperature range. The alloy should also be suitable for welding by techniques commonly used with stainless steel.

BRIEF DESCRIPTION OF THE DRAWINGS

The apparatus and method of the invention will be further described below and with reference to the appended drawings wherein like elements are referred to by the same numerals and in which.

DETAILED DESCRIPTION OF THE INVENTION

Figure 1:
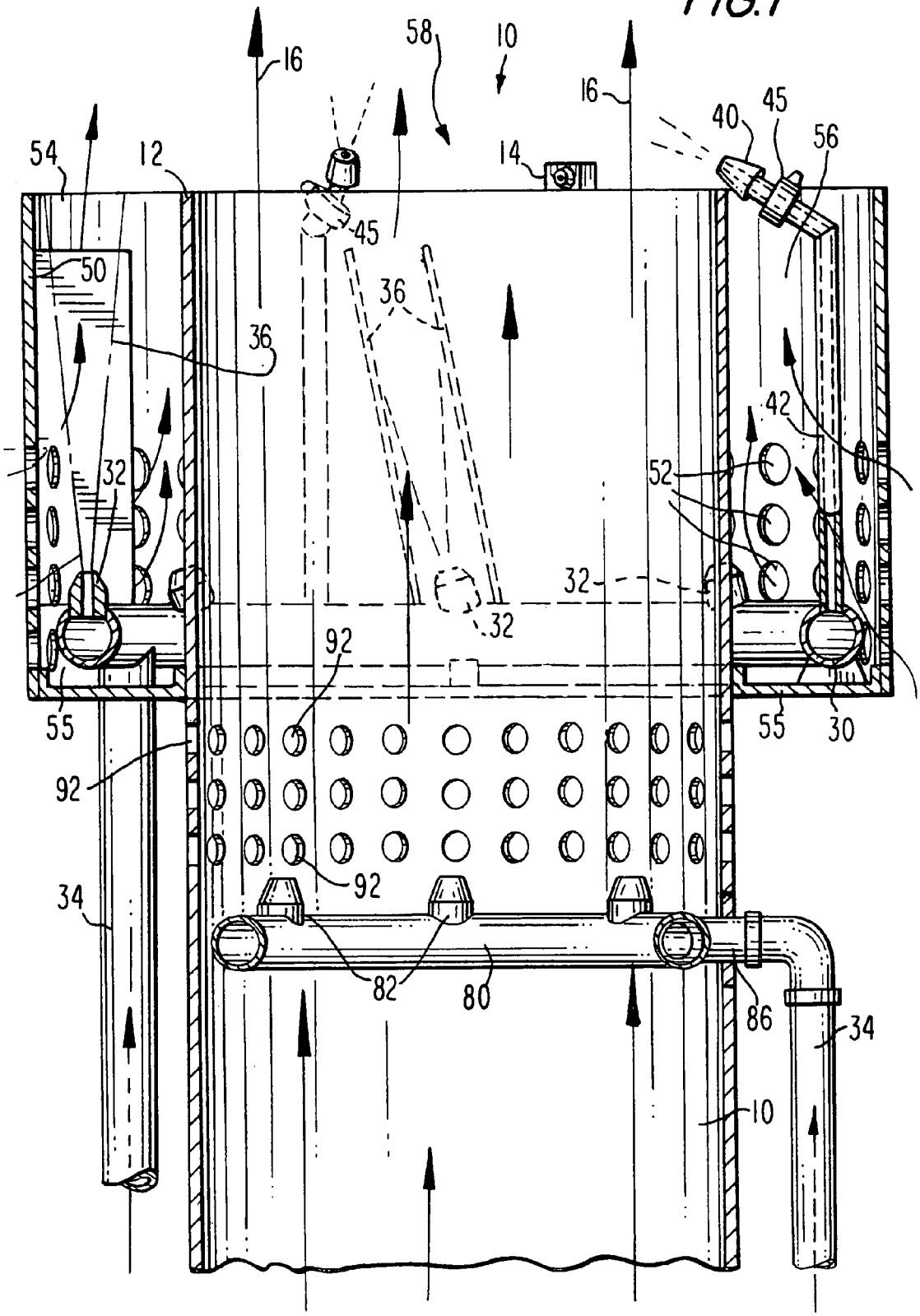
FIG. 1 is a cross-sectional view of the top portion of a flare stack, showing one preferred embodiment of the invention.

The invention will be further described with reference to FIG. 1, in which there is schematically illustrated the upper portion of a flaring stack (10) terminating in outlet or tip (12) that is open to the atmosphere. The stack is provided with one or more igniters (14) which are utilized in the conventional manner to ignite the combustible feedstream as it exits stack outlet (12). In this embodiment, a concentric barrier or shield (50) is positioned about the upper end portion of the stack, with its upper end (54) at the same elevation as the stack outlet (12). The composition of the combustible feedstream (16) and the specific configuration of the stack (10), outlet (12) and igniters can be of any configuration known to the prior art, or any new design developed in the future.

In the practice of the embodiment of the invention illustrated in FIG. 1, a high-pressure manifold (80) is positioned adjacent the interior surface of stack barrel (10) and fitted with nozzles (82) at spaced locations around the periphery to direct jets of air upwardly toward the stack outlet (12). In an especially preferred embodiment, the nozzles (82) are air amplifier nozzles that are capable of creating very large volumes of moving air using a relatively low volume of compressed air. The portion of the stack wall above the nozzles (82) is provided with openings or perforations (92) through which ambient air is drawn as a result of the low pressure zone created by the rapid moving jets of air emitted by nozzles (82). The manifold (80) is fed by conduit (86) attached to high pressure conduit (34). The number of air amplifier nozzles used will be determined by the diameter of the stack, volume of the feedstream, flow rates and other variables, and is within the skill of the art.

In the embodiment of FIG. 1, a high-pressure manifold (30) also encircles the exterior of the stack (10) and is provided with a plurality of high-pressure nozzles (32) or other outlets, each of which produces a jet of air that is directed upwardly in the direction of the stack outlet and flame. The manifold (30) is fed by high-pressure air conduit (34) that is fluid communication with a steady source of high-pressure air. In a preferred embodiment, the air is delivered to the nozzles at a pressure of about 30 to 35 psi.

Figure 2:
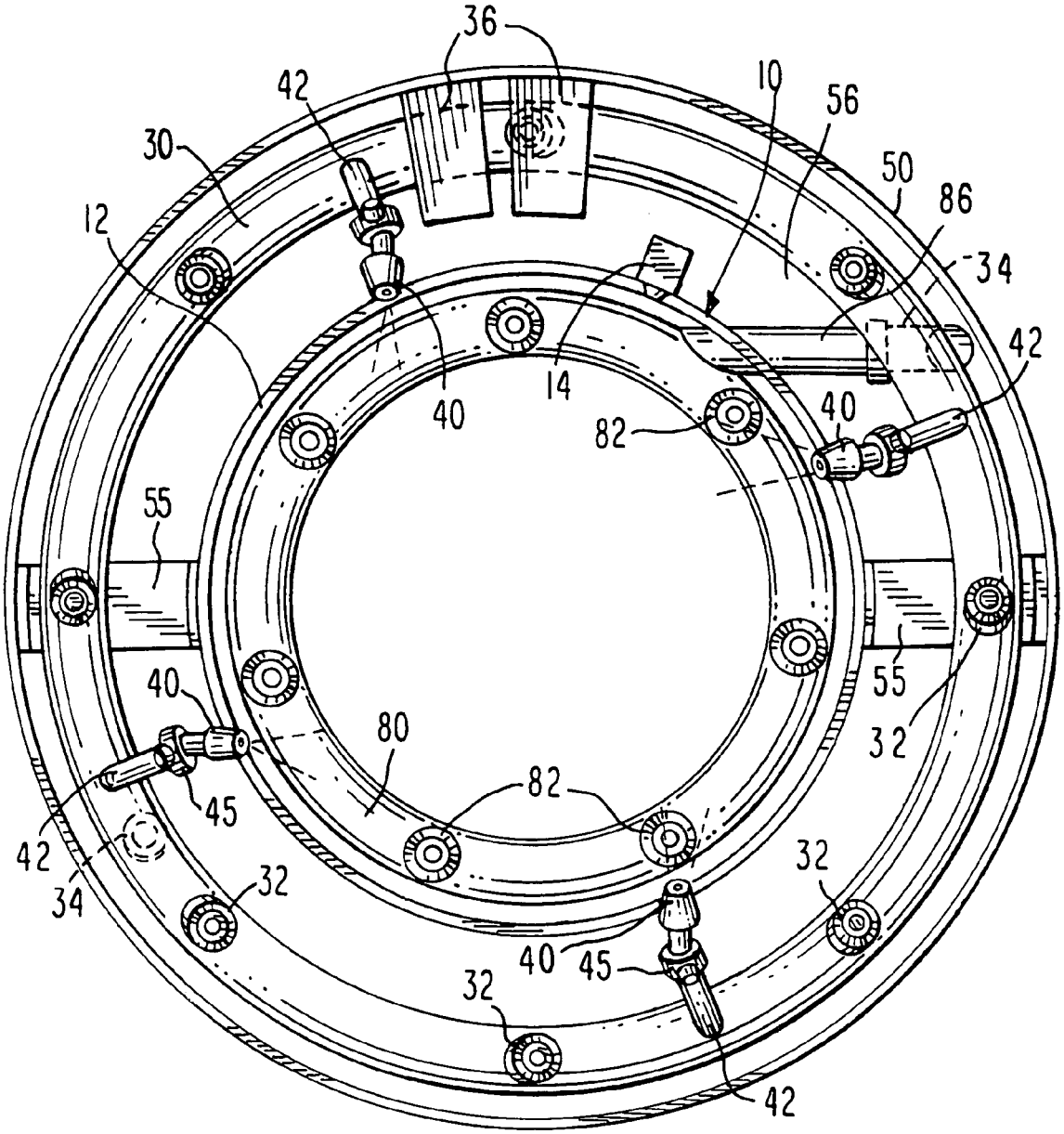
FIG. 2 is a top plan view of the embodiment of FIG. 1.

As shown in FIG. 2, the high-pressure nozzles are positioned on the interior and exterior manifolds (80) and (30) at predetermined intervals based upon the geometry of the flare stack, flare tip and the composition of the combustible feedstream and its pressure.

As will be understood from FIG. 1, the discharge of the pressurized air streams from nozzles (32) and (82) at a high-velocity creates a low-pressure zone in the vicinity of the nozzles as the air rises. Air is drawn into stack and into the annular region (56) between the stack (10) and shield (50). This induced air flow provides a large volume of air that rises towards the flame and eventually mixes with the hot gases to enhance the complete combustion of the fuel gas and undesired chemical(s) in the feedstream. The mixing is turbulent, which further enhances the complete combustion of the feedstream.

In order to assure a sufficient volume of atmospheric air flow from the area around and below the high-pressure nozzles (32) and (82), the stack (10) and the external shield (50) are preferably provided with a plurality of spaced air passages (52) and (92) about their respective perimeters. The size, number and spacing of the air passages (52, 92) are determined with respect to the air flow requirements of a particular installation. If the manifold is of a size and configuration that impedes the flow of the feedstream up the stack, or of the air between the stack and shield, then additional air passages (52, 92) are provided to assure a sufficient volume of air flow to provide the volume required to enhance complete combustion and turbulence at the flame zone.

The shield (50) around the tip can also serve to increase the turbulence in the combustion zone due to the high temperature difference between the metal and the air. The low-pressure transfer in the reaction or combustion zone promotes a smokeless reaction, and also controls the wind around the flame. The amount of compressed air used in the practice of the invention is very small compared to the air induced from the atmosphere. The ratio of compressed air volume to atmospheric air drawn into the stack and the annular space can be up to 1:300, depending on the configuration of the rings and nozzles.

Figure 3:
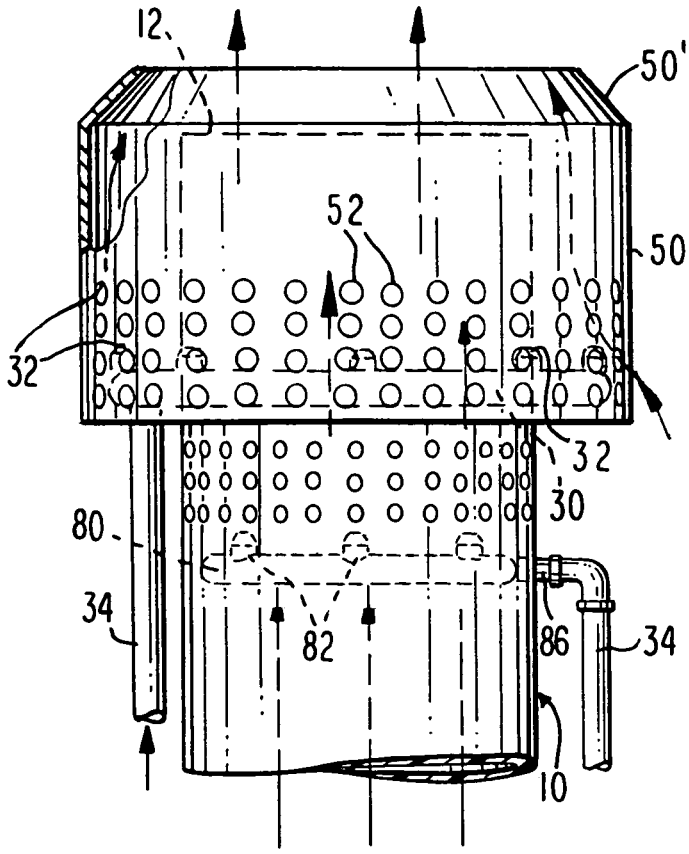
FIG. 3 is a side elevation view of a flare tip showing another embodiment of the invention used with a flare tip shield of a different design.
Figure 4:
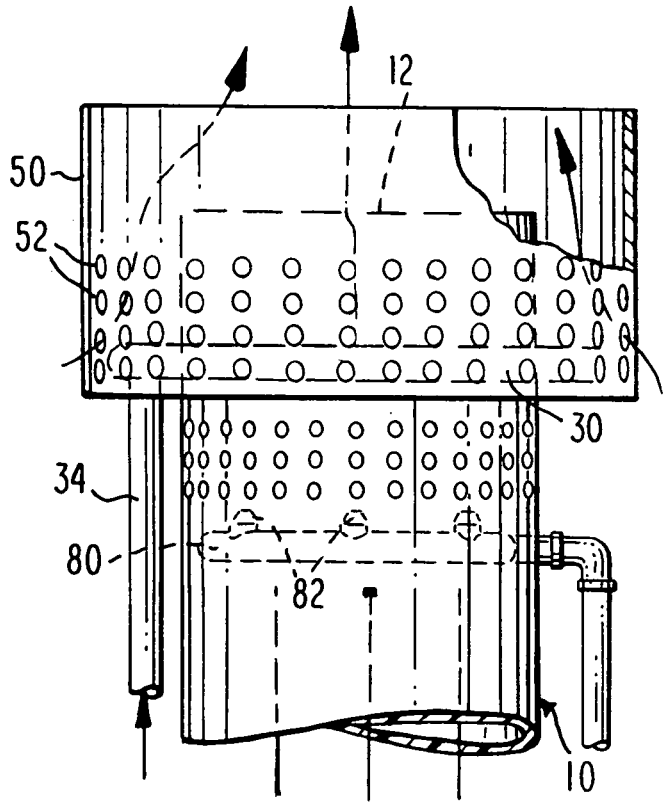
FIG. 4 is a side elevation view of a flare tip showing further embodiment of the invention used with a flare tip shield of yet a different design.

With continuing reference to FIGS. 1 and 2, a plurality of spaced vanes or baffles (36) are optionally provided to direct the air flow in the annular space between the stack (10) and shield (50). In the interest of clarity, the number of vanes illustrated is limited in FIG. 1-3. The vanes can serve to provide a more uniform air distribution at the center of the flame by moving the expanding air mass in a directed path through the annular space 56 into which the vanes project. In a preferred embodiment of the invention, vanes are attached to the shield flanking each of the high-pressure nozzles and are inclined from the vertical at any angle comparable to the angle of the air jet emanating from the adjacent nozzle. Thus, in the embodiment illustrated, a total of sixteen vanes will be provided, two associated with each of the eight high-pressure air discharge nozzles. The vanes can be of a spiral configuration to direct the rising air mass toward the stack rim.

In a further preferred embodiment, a plurality of low-pressure wind control nozzles (40) fed by conduits (42), are spaced about the periphery of the stack outlet (12). Nozzles (40) are supplied by a low-pressure air supply.

As shown in FIG. 1, the nozzles (40) are in fluid communication with the pressure reducing device (45) downstream on conduit (42). Alternatively, a separate low pressure manifold system (not shown) can be provided. Other alternative arrangements for the either/or both the high and low pressurized air feed and distribution systems will be apparent to those of ordinary skill in the art.

The wind control nozzles (40) function to minimize the effect of atmospheric cross winds that can disrupt the optimum combustion pattern of the flame, and to push the carbon dioxide combustion product away from the flame to prevent further undesired reactions. In a preferred embodiment, nozzles (40) have a diameter of about 0.0625 in/2 mm and are positioned at 90 degree intervals about the top of the stack. The low pressure nozzles (40) are directed at a 45 degree angle to the diameter line across the stack opening.

In the preferred embodiment described above, manifold (30) is fitted with a plurality of high-pressure nozzles (32). In an alternative embodiment, the tubular manifold (30) can be machined or otherwise provided with a plurality of directionally oriented outlets for the discharge of the high-pressure air in place of nozzles (32). These outlets are preferably at an angle of about 45° and emit the jets of high pressure air in a direction that is tangential to the adjacent stack surface. i.e., the horizontal vector of the air jet is normal to a diameter passing through the outlet.

An important aspect of this invention is the use of air jets that induce high amounts of air from the environment. The principal apparatus used includes distribution rings and nozzles. The distribution ring can have the nozzles installed on its surface or jetting air can exit the ring through a plurality of appropriate fittings. The design and type of nozzle is chosen to produce a high-velocity jet of air and an associated zone of relatively low-pressure that induces atmospheric air from the vicinity of the combustion zone to promote a complete reaction of the feedstream.

Figure 5:
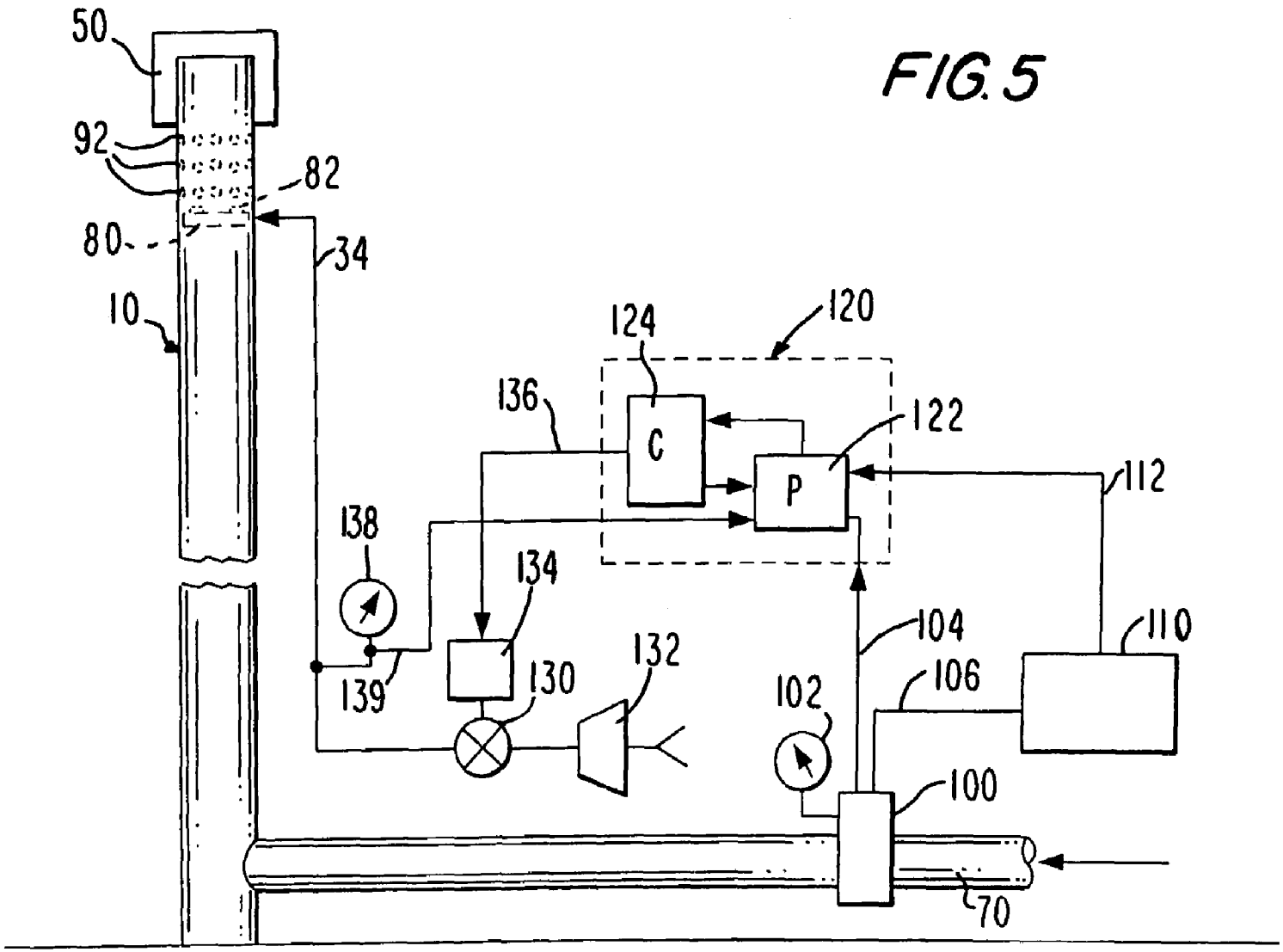
FIG. 5 is a schematic illustration of an air control system of the invention.

Referring now to the schematic illustration of FIG. 5, the stack feedstream conduit (70) is admitted to the lower portion of flaring stack (10) as a multi-component mass of gases. The feedstream passes through a sampling zone (100) that includes a flow-rate measuring gauge (102) which can provide both a visual readout and a digital signal that is transmitted via line (104) to control means (120). A feedstream sampling conduit (106) from sampling zone (100) delivers a sample of the feedstream to analytical means (110) at predetermined intervals. The results of the analysis are converted to digital signals at (110) and transmitted via signal line (112) to control means (120). A programmed processor (122) by a converter associated with the analytical means calculates the stoichiometric oxygen requirements for the combustible compounds identified by analytical means (110) and stores the result, along with all of the historical incoming data in a memory device. As appropriate, the processor transmits digital instructions to a controller (124) to adjust the flow of air into the upper portion of flaring stack (10) through high pressure conduit (34).

The high pressure air can be provided via a compressor (132) or from any other convenient source available at the facility. An air flow control valve (130) is provided with a valve controller (134) that is connected via signal line (136) to receive signals from the controller (124). A high pressure air flow indicator gauge (138) can also provide a visual readout and a digital signal that is transmitted to the processor (122) via line (139).

In the method of operation of this embodiment of the invention, a change in the composition of the feedstream in feed conduit (70) is determined by the processor (122) and transmitted to the controller (124) which in turn transmits the appropriate signal to valve controller (134) to make the appropriate adjustment to air flow control valve (130). For example, if the stoichiometric oxygen requirement increases as a result of a change in the composition of the feedstream, valve (130) is opened to increase the high-pressure air flow through feed conduit (34) to the manifold (80) and nozzles (82) in the upper end of the stack. The programmed operation of control means (120) takes into account the overall effects of the increased airflow through the nozzles in the amount of ambient air drawn into the stack and/or to the annular space between the stack and shield (50).

Figure 6:
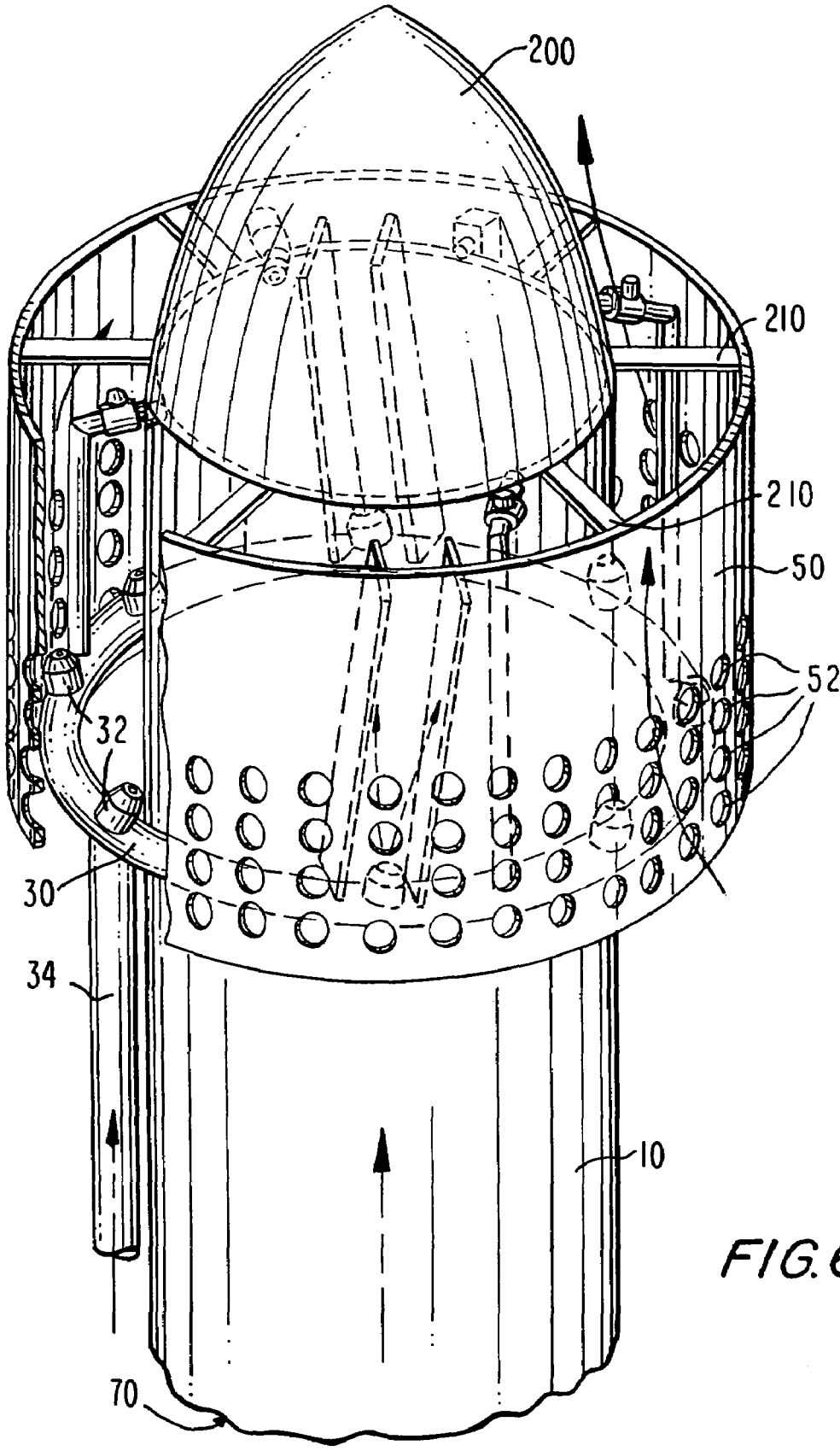
FIG. 6 is a top side perspective view, partly in section, showing another preferred embodiment of the invention.

Referring now to the schematic illustration of FIG. 6 a Coanda-effect body member (200) is shown in position supported above the outlet of flare stack (10). In the embodiment illustrated, a plurality of supports (210) extend from the adjacent surrounding shield (50) and are preferably of a corrosion-resistant material and have a streamlined cross-section to minimize the drag of the passing fluid stream and its potentially corrosive effects.

In this embodiment, the high-pressure air nozzles (32) are connected to a circular manifold (30) which surrounds the exterior surface of the upper end of the stack. The concentric shield is provided with perforations (52) to admit ambient air into the annular low-pressure region created by the effect of the rapidly moving air emanating from the high-pressure nozzles.

The Coanda-effect body member (200) is configured to maximize the flow of the feedstream along its exterior surface, which in turn will produce the turbulent mixing of air in the mixing zone and the eventual complete combustion of the undesired chemical(s) and fuel in the combustion zone above the body.

As will be understood from the illustration of FIG. 6, the Coanda-effect body member has a vertical axis that is positioned in alignment with the longitudinal axis of the flaring stack. This positioning enhances the symmetrical flow of the rising feedstream (70) and airstreams into impingement and eventual flowing contact with the surface of the Coanda body member (200).

The invention has been illustrated and described with reference to a number of specific embodiments. As will be apparent to one of ordinary skill in the art, modifications and other combinations of the elements and functions can be undertaken without departing from the basic invention, the extent and scope of which are to be determined with reference to the attached claims.

We claim:

1. An apparatus for enhancing the complete combustion of an undesired chemical and to thereby minimize the formation of smoke in the operation of a flare stack, the flare stack having a sidewall terminating in an outlet for the discharge of a flare feedstream comprising a combustible mixture formed by the undesired chemical and a fuel gas, an igniter located proximate the stack outlet, and a shield that is spaced apart from and surrounds the outside surface of the stack proximate the stack outlet, the apparatus comprising:

a. a plurality of high pressure air amplifier nozzles at spaced apart positions on the interior of the stack and displaced below the lower edge of the flare stack outlet, each of the air amplifier nozzles directed toward the stack outlet and in the direction of the feedstream's movement;

b. a source of high pressure air in fluid communication with the plurality of amplifier nozzles; and c. a plurality of openings passing through the side wall of the stack above the air amplifier nozzles, whereby the discharge of the air from the amplifier nozzles forms a plurality of high-velocity air jets to produce a moving air mass that draws additional atmospheric air into the feedstream moving up the stack to enhance the mixing of the flare feedstream with external ambient air.

2. The apparatus of claim 1 which further includes a high pressure air manifold, each of the high pressure air amplifier nozzles being mounted on the manifold, the manifold being in fluid communication with the high pressure air source.

3. The apparatus of claim 2, wherein the manifold is positioned in close proximity to the surface of the interior wall of the flare stack.

4. The apparatus of claim 1, wherein the air jet discharged from each of the plurality of air amplifier nozzles is aligned with the axis of the flare stack.

5. The apparatus of claim 1, wherein the shield is concentric with the flare stack.

6. The apparatus of claim 5, wherein the air amplifier nozzles are at a position that is below the lower edge of the shield.

7. The apparatus of claim 1 which further includes Coanda-effect body positioned above the open end of the stack outlet.

8. The apparatus of claim 1 which further includes: a. analytical means for determining the stoichiometric oxygen requirements to assure the complete combustion of the undesired chemical and the fuel gas constituting the feed stream at predetermined times; b. an air flow control valve for controlling the flow rate of the high pressure air to the nozzles; and c. air flow control means operably associated with the flow control valve to adjust the mass flow rate of high pressure air in response to the determination of the minimum oxygen requirements by the analytical means, whereby the oxygen content of the high pressure air flow meets or exceeds the requirement for the complete combustion of the feedstream.

9. A method of enhancing the complete combustion of an undesired chemical and minimizing the formation of smoke in the operation of a flare stack, the flare stack having a sidewall terminating in an outlet, the method comprising:

a. providing a flare feedstream formed from a combustible mixture of the undesired chemical and a fuel gas;

b. discharging the flare feedstream from the outlet of the flare stack;

c. igniting the flare feedstream to form a flame in a combustion zone;

d. providing a plurality of high velocity air streams in the form of amplifier air jets spaced apart at positions around the periphery of the interior of the flare stack and upstream of the stack outlet, each of the plurality of air jets moving upwardly toward the combustion zone to thereby create a low-pressure zone below the stack outlet; and e. providing a plurality of ambient air inlets passing through the sidewall of the stack proximate the low pressure zone created by the air amplifier jets, whereby an influx of ambient atmosphere air into the low pressure zone turbulently mixes with the flare feedstream in advance of the combustion zone to thereby provide enhanced combustion of the flare feedstream.

10. The method of claim 9, wherein each of the plurality of air jets moves along the interior wall of the stack from a position below the stack outlet.

11. The method of claim 10, in which the air inlets are provided by a plurality of generally circular openings around the periphery of the stack, whereby atmospheric air surrounding the stack is drawn into the stack and mixes with the feedstream.

12. The method of claim 9 which includes the further steps of providing an exterior concentric shield surrounding and spaced apart from the periphery of the portion of the flare stack adjacent the outlet and channeling ambient atmospheric air upwardly toward the stack outlet.

13. The method of claim 12, wherein a plurality of perforations pass through the concentric barrier shield and atmospheric air passes through the perforations in the barrier shield and the stack wall below the concentric barrier shield.

14. A method of enhancing the complete combustion of an undesired chemical and minimizing the formation of smoke in the operation of a flare stack, the flare stack having a sidewall terminating in an outlet, the method comprising:

a. providing a flare feedstream formed from a combustible mixture of the undesired chemical and a fuel gas;

b. discharging the flare feedstream from the outlet of the flare stack;

c. igniting the flare feedstream to form a flame in a combustion zone;

d. providing a plurality of high velocity air streams in the form of air amplifier jets located on the interior of the flare stack at a position below the stack outlet and spaced apart at predetermined positions around the periphery of the interior of the flare stack, each of the plurality of air amplifier jets discharging air upwardly toward the combustion zone to thereby create an internal low pressure zone below the stack outlet;

e. providing a plurality of regularly spaced perforations passing through the sidewall of the stack beginning at a position that is proximate the air amplifier jets, whereby the air jets cause an influx of ambient atmospheric air into the low pressure zone through the perforations in the sidewall of the stack and the turbulent mixing of the atmospheric air with the flare feedstream to thereby provide oxygen for the complete combustion of the feedstream.

15. The method of claim 14, wherein each of the plurality of air jets is positioned below the perforations in the flare stack.

16. The method of claim 14 which includes the further step of providing an exterior concentric shield extending around and spaced apart from the periphery of the portion of the flare stack adjacent the outlet and the perforations in the flare stack begin at a position that is below the lower edge of the shield.

17. The method of claim 16, which includes the further step of providing of a plurality of openings positioned adjacent the downstream end of the concentric shield.

18. The method of claim 16, wherein the concentric shield extends to a position above the stack outlet.

19. The method of claim 14 which includes the further step of mechanically constricting the flow area of the flare feedstream proximate the stack outlet.

20. The method of claim 14 which includes the further step of passing the air and feedstream mixture discharged from the stack outlet over the surface of a Coanda-effect body, thereby further mixing the feedstream with atmospheric air.

21. The method of claim 14 which includes the further steps of providing:

b. a source of high pressure air in fluid communication with the plurality of nozzles, whereby the discharge of the air from the nozzles forms a plurality of high-velocity air jets to produce a moving air mass that draws additional atmospheric air into the mass of air moving toward the stack outlet to thereby enhance combustion of the flare feedstream;

c. analytical means for determining the stoichiometric oxygen requirements to assure the complete combustion of the undesired chemical and the fuel gas constituting the feedstream at predetermined times;

d. an air flow control valve for controlling the flow rate of the high pressure air to the nozzles;

e. air flow control means operably associated with the flow control valve to adjust the mass flow rate of high pressure air in response to the determination of the minimum oxygen requirements by the analytical means; and controlling the flow rate of the high pressure air discharged from the air jets to provide an oxygen level at the flare tip that meets or exceeds the requirement for the complete combustion of the feedstream.

22. An apparatus for enhancing the complete combustion of an undesired chemical and to thereby minimize the formation of smoke in the operation of a flare stack, the flare stack having a sidewall terminating in an outlet for the discharge of a flare feedstream comprising a combustible mixture formed by the undesired chemical and a fuel gas, an igniter located proximate the stack outlet, and a shield that is spaced apart from and surrounds the outside surface of the stack proximate the stack outlet, the apparatus comprising:

a. a plurality of high pressure air amplifier nozzles at spaced apart positions on the interior of the stack and displaced below the lower edge of the flare stack outlet, each of the air amplifier nozzles directed toward the stack outlet and in the direction of the feedstream's movement;

b. a source of high pressure air in fluid communication with the plurality of amplifier nozzles; and c. a plurality of openings passing through the side wall of the stack above the air amplifier nozzles, whereby the discharge of the air from the amplifier nozzles forms a plurality of high-velocity air jets to produce a moving air mass that draws additional atmospheric air into the feedstream moving up the stack to enhance the mixing of the flare feedstream with external ambient air, wherein the downstream portion of the shield is provided with a plurality of air inlet passages passing through the wall of the shield.

23. The apparatus of claim 22 which further includes a plurality of low pressure wind control nozzles positioned around the periphery of the stack outlet and in communication with a source of low pressure air, whereby a curtain of air is formed to extend upwardly from the outlet at the base of the flame.

* * * * *